US012378714B2

(12) United States Patent
Snapir

(10) Patent No.: US 12,378,714 B2
(45) **Date of Patent: *Aug. 5, 2025**

(54) WALL MOUNTED MOTORIZED CLOTHES HANGING DEVICES

(71) Applicant: SMART FENCE LTD, Karme Yosef (IL)

(72) Inventor: Nir Snapir, Karme Yosef (IL)

(73) Assignee: SMART FENCE LTD, Karme Yosef (IL)

( * ) Notice: Subject to any disclaimer, the term of this patent is extended or adjusted under 35 U.S.C. 154(b) by 0 days.

This patent is subject to a terminal disclaimer.

(21) Appl. No.: 18/854,823

(22) PCT Filed: May 10, 2023

(86) PCT No.: PCT/IL2023/050477

§ 371 (c)(1),
(2) Date: Oct. 7, 2024

(87) PCT Pub. No.: WO2023/223311

PCT Pub. Date: Nov. 23, 2023

(65) Prior Publication Data

US 2025/0109544 A1 Apr. 3, 2025

(30) Foreign Application Priority Data

May 19, 2022 (IL) ..... 293151

(51) Int. Cl.
*D06F 53/04* (2006.01)
*A47B 61/02* (2006.01)

(52) U.S. Cl.
CPC ..... *D06F 53/045* (2013.01); *A47B 61/02* (2013.01)

(58) Field of Classification Search
CPC ..... D06F 53/045; D06F 53/00; D06F 53/02; D06F 57/08; D06F 57/12; A47B 61/02; A47B 49/008; A47B 63/067
USPC ..... 211/1.51, 87.01, 1.57, 119.1, 119.15
See application file for complete search history.

(56) References Cited

U.S. PATENT DOCUMENTS 442,044 A * 12/1890 Hatfield ..... B65G 1/133 211/122
1,310,424 A * 7/1919 Lucoff ..... A47F 3/08 211/121
2,166,771 A * 7/1939 Robertson ..... D06F 53/045 211/119.15
2,206,174 A * 7/1940 Falk ..... D06F 53/045 242/388.6

(Continued)

FOREIGN PATENT DOCUMENTS

CN 2217633 Y 1/1996
CN 104631067 A 5/2015

(Continued)

*Primary Examiner* — Jennifer E. Novosad
(74) *Attorney, Agent, or Firm* — Bridgeway IP Law Group, PLLC; Hyun Woo Shin

(57) ABSTRACT

Wall mounted motorized clothes hanging devices including a housing, a rigid beam having a retracted storage position and an extended clothes hanging position, a pair of folding arms between the housing and the rigid beam, and a motorized gear arrangement for deploying the rigid beam between its retracted storage position and its extended clothes hanging position.

2 Claims, 8 Drawing Sheets

(56) References Cited

U.S. PATENT DOCUMENTS

| | | | | | |
|---|---|---|---|---|---|
| 3,096,884 | A * | 7/1963 | Leshner | D06F 53/045 | 242/395 |
| 5,816,417 | A * | 10/1998 | Reaves | D06F 57/06 | 211/180 |
| 9,051,680 | B1 * | 6/2015 | Harris | D06F 57/12 | |
| 12,195,994 | B2 * | 1/2025 | Snapir | E04H 4/06 | |

FOREIGN PATENT DOCUMENTS

| | | | | | |
|---|---|---|---|---|---|
| CN | 105350271 | A | | 2/2016 | |
| CN | 105714529 | A | | 6/2016 | |
| CN | 108330657 | A | | 7/2018 | |
| CN | 108691172 | A | | 10/2018 | |
| CN | 109944037 | A | | 6/2019 | |
| CN | 110528232 | A | | 12/2019 | |
| CN | 209816524 | U | | 12/2019 | |
| CN | 111286939 | A | | 6/2020 | |
| CN | 210712236 | U | | 6/2020 | |
| CN | 212247556 | U | | 12/2020 | |
| CN | 112227029 | A | | 1/2021 | |
| CN | 112609409 | A | | 4/2021 | |
| CN | 213061438 | U | | 4/2021 | |
| CN | 213173036 | U | | 5/2021 | |
| CN | 214089077 | U | | 8/2021 | |
| CN | 215593459 | U | | 1/2022 | |
| JP | 2011019629 | A | * | 2/2011 | |
| KR | 10-2021-0097971 | A | | 8/2021 | |
| WO | WO-2023223311 | A1 | * | 11/2023 | D06F 57/08 |

* cited by examiner

WALL MOUNTED MOTORIZED CLOTHES HANGING DEVICES

FIELD OF THE INVENTION

The invention relates to wall mounted motorized clothes hanging devices.

BACKGROUND OF THE INVENTION

Clothes hanging devices include free standing structures, wall mounted structures, and ceiling mounted structures. Clothes hanging devices include manual operated structures and motorized structures. Motorized structures can be operated by a switch, a remote control, and the like.

Exemplary clothes hanging devices are disclosed inter ilia in CN 104,631,067, CN 108,330,657, CN 108,691,172, CN 110,528,232, CN 111,286,939, CN 112,227,029, CN 112,609,409, CN 209,816,524, CN 210,712,236, CN 212,247,556, CN 213,061,438, CN 213,173,036, CN 214,089,077 and KR210210097971.

There is a need for compact wall mounted motorized clothes hanging devices.

SUMMARY OF THE INVENTION

The present invention is for wall mounted motorized clothes hanging devices including a housing, a rigid beam having a retracted storage position and an extended clothes hanging position, a pair of folding arms between the housing and the rigid beam, and a motorized gear arrangement for deploying the rigid beam between its retracted storage position and its extended clothes hanging position. The housing includes a self-winding clothes rack having a left cable, a right cable and a roll of clothes lines therebetween. The self-winding clothes rack enables extending the rigid beam until the left cable and the right cable are stretched forwardly tautly, thereby unrolling the roll of clothes lines to present a horizontal rack of clothes lines tautly stretched therebetween and determining the rigid beam's extended clothes hanging position. The housing, the rigid beam, and the extended pair of folding arms constitute a rigid frame for supporting a washing machine load of wet clothes hung on the horizontal rack of clothes lines. Such washing machine loads of wet clothes can weigh, say, 20 kg. The self-winding clothes rack self-winds on retracting the rigid beam from its extended clothes hanging position to its retracted storage position.

BRIEF DESCRIPTION OF DRAWINGS

In order to understand the present invention and to see how it can be carried out in practice, a preferred embodiment will now be described, by way of a non-limiting example only, with reference to the accompanying drawings, in which similar parts are likewise numbered, and in which.

DETAILED DESCRIPTION OF DRAWINGS

Figure 1:
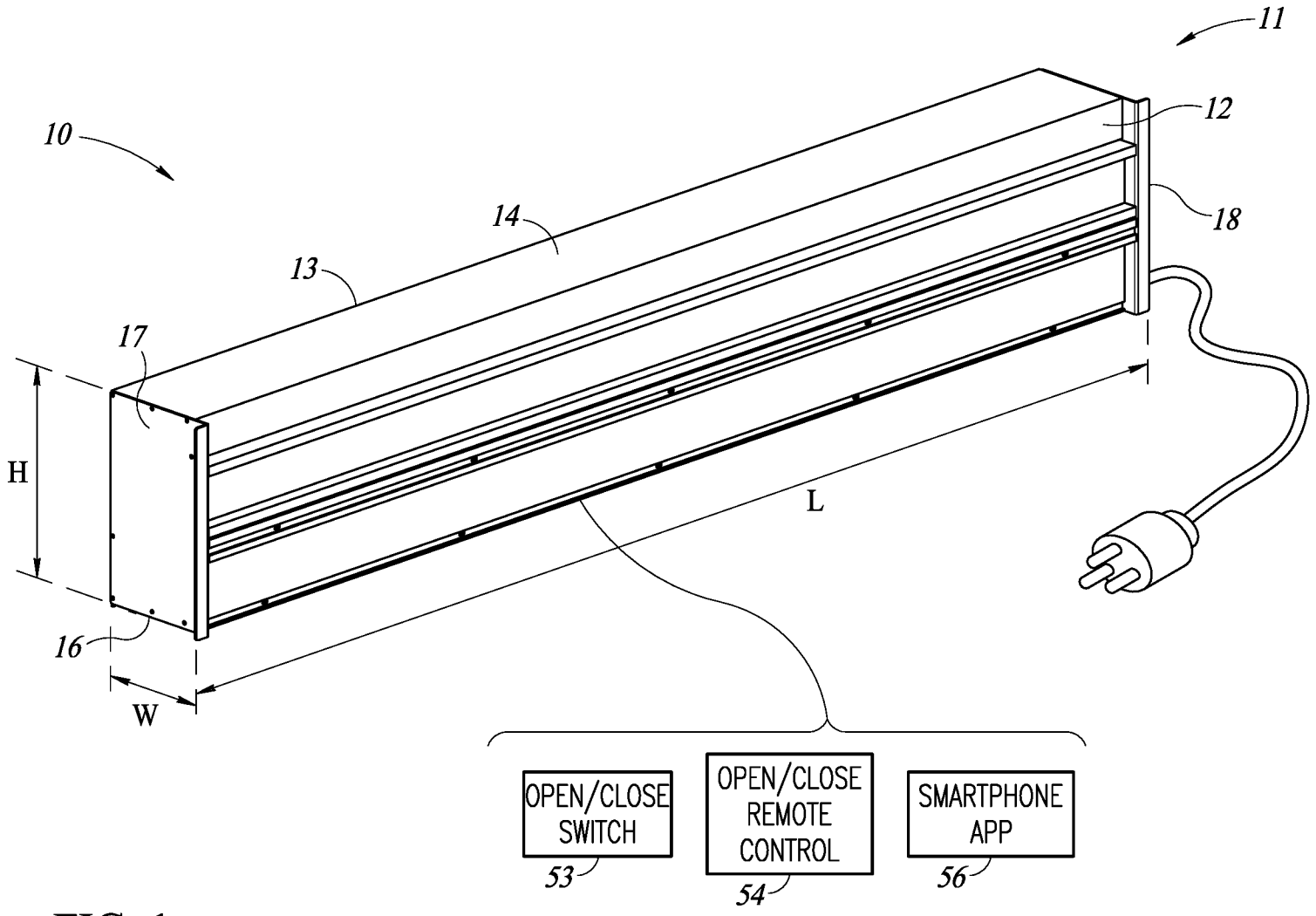
FIG. 1 is a front perspective view of a wall mounted motorized clothes hanging device.
Figure 2A:
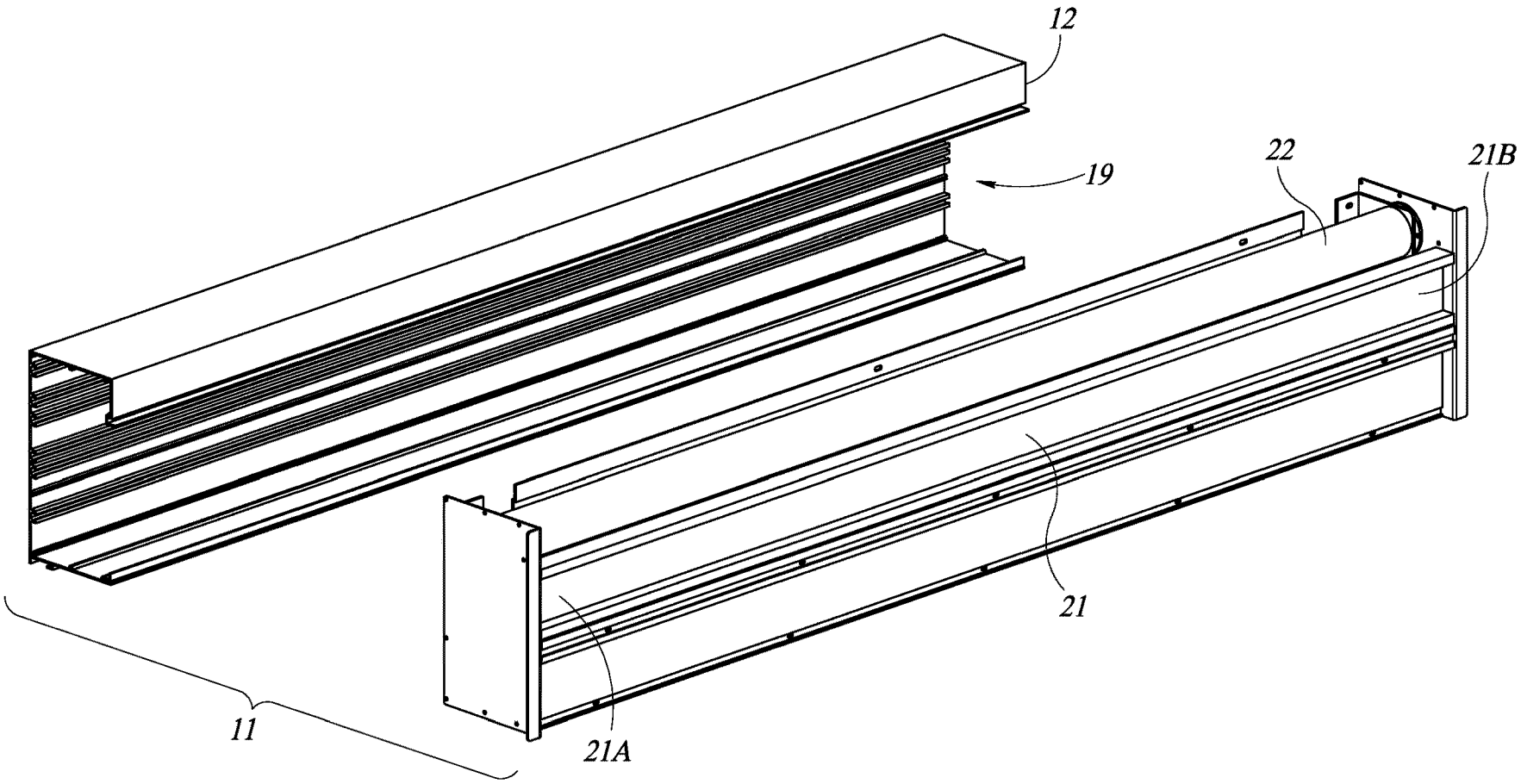
FIG. 2A is a partial exploded front perspective view of the motorized clothes hanging device.
Figure 2B:
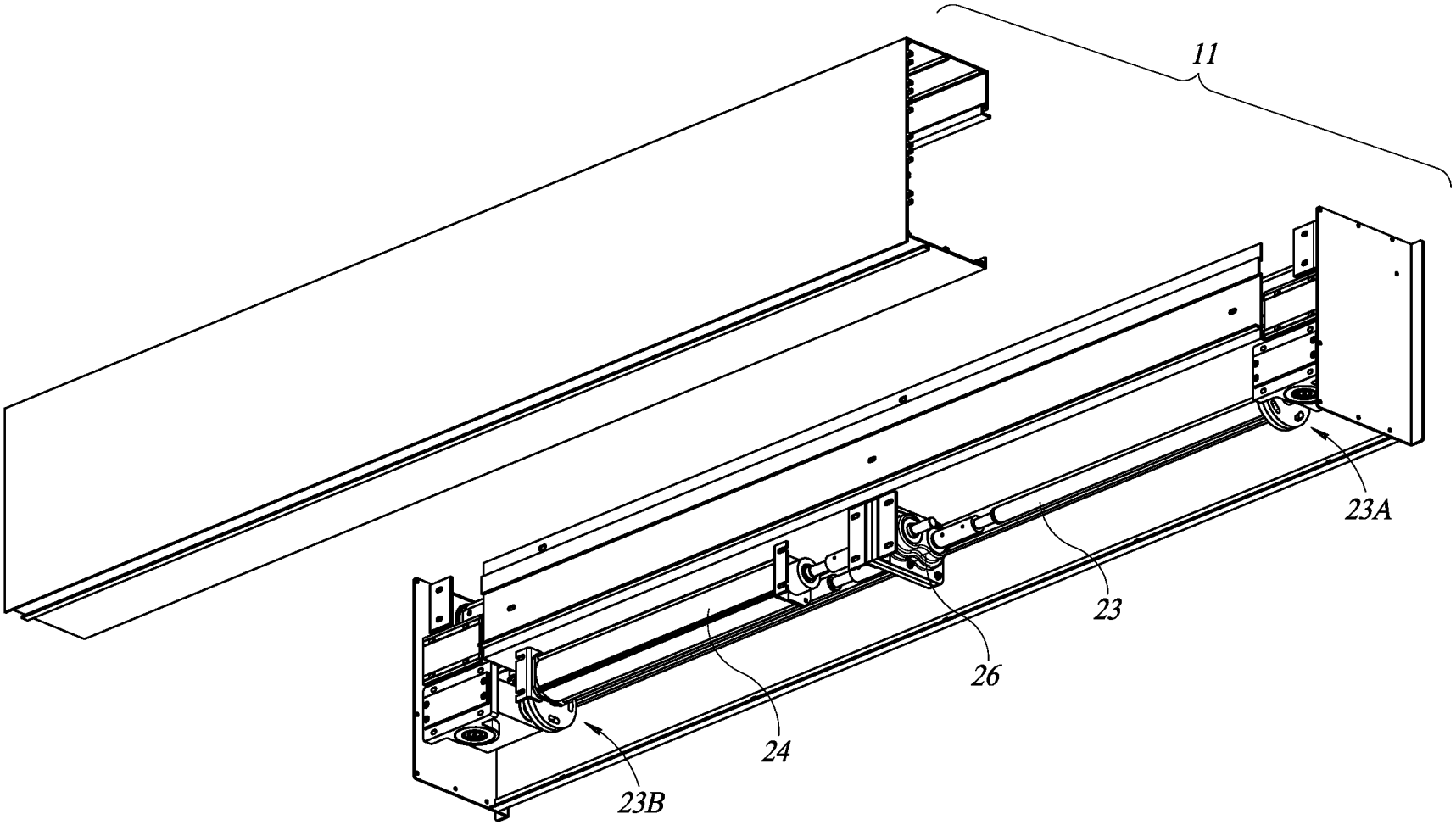
FIG. 2B is a partial exploded rear perspective view of the motorized clothes hanging device.
Figure 3:
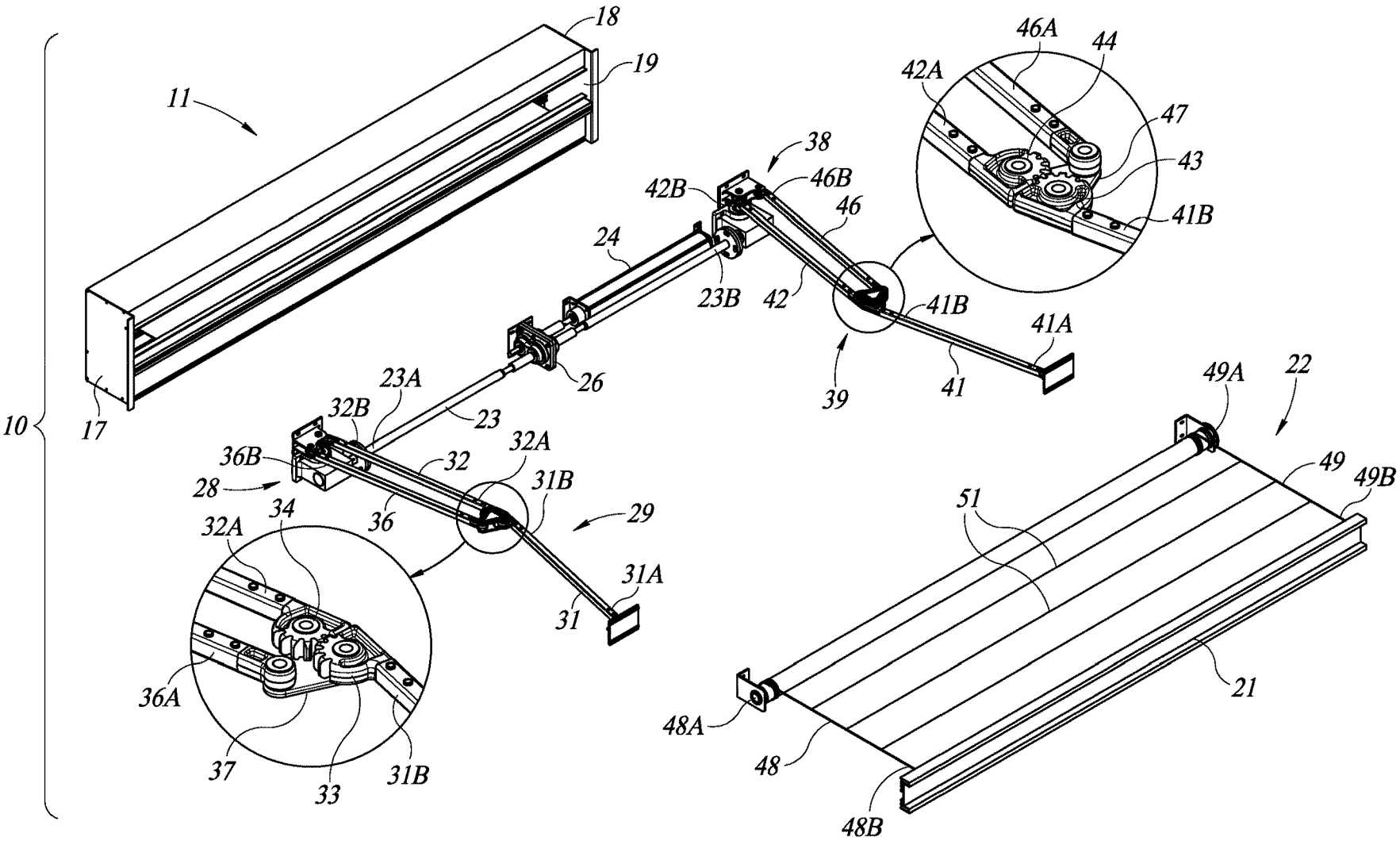
FIG. 3 is an exploded view of the motorized clothes hanging device.
Figure 4A:
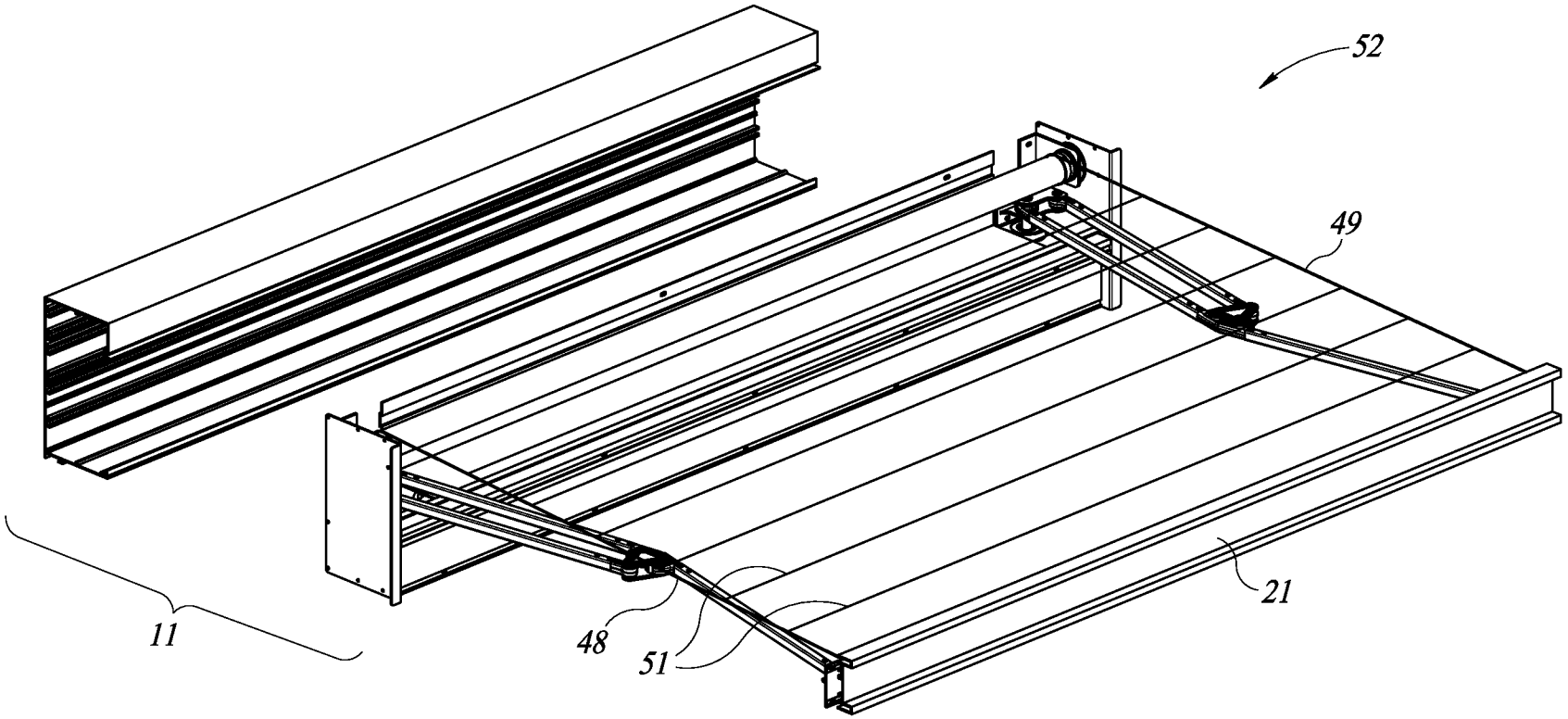
FIG. 4A is a partial exploded front perspective view of the motorized clothes hanging device in a clothes hanging position.
Figure 4B:
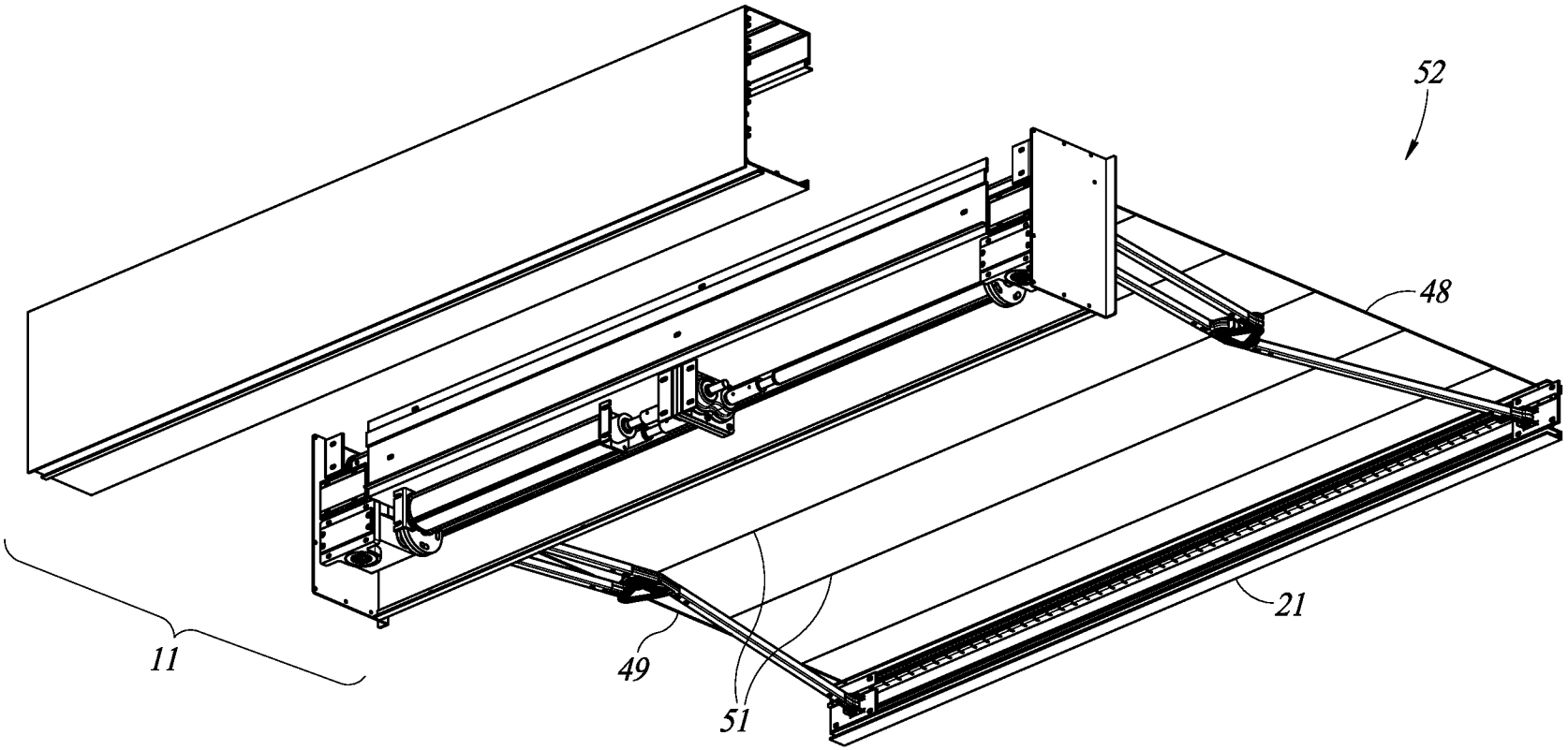
FIG. 4B is a partial exploded rear bottom perspective view of the motorized clothes hanging device in its clothes hanging position.

FIG. 1 to FIG. 6 show a motorized wall mounted clothes hanging device 10 having a generally parallelopiped housing 11 with a front panel 12, a rear panel 13, a top panel 14, a bottom panel 16, a left end panel 17 and a right end panel 18. The housing 11 is intended to be mounted horizontal on a wall. The front panel 12 is formed with a frontmost lengthwise slot 19 extending therealong. The housing 11 has the following external dimensions: length L, width W and height H. Length L can be a wide range of lengths from, say, 1 m to 3 m. Width W can be in a wide range of widths, say, 20 cm to 40 cm. Height H can be in a wide range of heights, say, 15 cm to 35 cm. The motorized clothes hanging device 10 can be powered by the mains, a rechargeable battery, and the like. The clothes hanging device 10 can be operated by a manual OPEN/CLOSE switch 53, an OPEN/CLOSE remote control 54, a smartphone app 56, and the like.

The clothes hanging device 10 includes a rigid beam 21 having a left beam end 21A and a right beam end 21B, the rigid beam 21 having a retracted storage position and an extended clothes hanging position forward with respect to the retracted storage position. The rigid beam 21 is preferably flush with the front panel 12 in its retracted storage position. The clothes hanging device 10 includes a self-winding clothes rack 22 installed in the housing 11.

The clothes hanging device 10 includes an axle 23 having a left axle end 23A and a right axle end 23B, and co-extensive with the rigid beam 21. The clothes hanging device 10 includes an electric motor 24 for clockwise and counterclockwise rotating the axle 23 via a gear transmission 26. The electric motor 24 is preferably a commercially available low profile tubular motor. The electric motor 24 preferably includes an automatic switch-off feature for automatically switching itself off when the motorized clothes hanging device 10 is in its retracted storage position and its extended clothes hanging position.

The clothes hanging device 10 includes a left worm gear 28 at the left axle end 23A for driving a left folding arm 29 between a folded position and an extended forward position. The left folding arm 29 includes a left front arm 31 and a left rear arm 32. The left front arm 31 includes a leading left front arm end 31A pivotally connected to the rigid beam 21 and a trailing left front arm end 31B with a left front arm gear wheel 33. The left rear arm 32 includes a leading left rear arm end 32A with a left rear arm gear wheel 34 engaging the left front arm gear wheel 33 and a trailing left rear arm end 32B driven by the left worm gear 28. The clothes hanging device 10 further includes a left support arm 36 including a leading left support arm end 36A having a pivotally connected bracket 37 pivotally connected to the trailing left front arm end 31B and the leading left rear arm end 32A and a trailing left support arm end 36B rotatably connected to the housing 11 such that the left support arm 36 moves in tandem with the left folding arm 29.

The clothes hanging device 10 includes a right worm gear 38 at the right axle end 23B for driving a right folding arm 39 between a folded position and an extended forward position. The right folding arm 39 includes a right front arm 41 and a right rear arm 42. The right front arm 41 includes a leading right front arm end 41A pivotally connected to the rigid beam 21 and a trailing right front arm end 41B with a right front arm gear wheel 43. The right rear arm 42 includes a leading right rear arm end 42A with a right rear arm gear wheel 44 engaging the right front arm gear wheel 43 and a trailing right rear arm end 42B driven by the right worm gear 38. The clothes hanging device 10 further includes a right support arm 46 including a leading right support arm end 46A having a pivotally connected bracket 47 pivotally connected to the trailing right front arm end 41B and the leading right rear arm end 42A whereby the right support arm 46 moves in tandem with the right folding arm 39.

The self-winding clothes rack 22 includes a left cable 48 on the housing 11's left side, a right cable 49 on the housing 11's right side and a roll of clothes lines 51 between the left cable 48 and the right cable 49. The left cable 48 has a cable end 48A installed in the housing 11 and an opposite cable end 48B attached to the rigid beam 21. The right cable 49 has a cable end 49A installed in the housing 11 and an opposite cable end 49B attached to the rigid beam 21. Alternatively, the opposite cable end 48B can be attached to the leading left front arm end 31A and the opposite cable end 49B can be attached to the leading right front arm end 41A. The self-winding clothes rack 22 preferably includes a self-winding left cable 48 and a self-winding right cable 49. The self-winding clothes rack 22 is preferably spring biased.

The clothes rack 22, the left folding arm 29, and the right folding arm 39 are dimensioned such that the clothes rack 22 restrains full extension of the left folding arm 29 and the right folding arm 39. In other words, forward extending the rigid beam 21 until the clothes rack 22 is stretched tautly restrains the rigid beam 21 such that the clothes rack 22 determines the rigid beam 21's extended clothes hanging position. Forward movement of the rigid beam 21 leads to unwinding the roll of clothes lines 51 to present a horizontal rack of clothes lines 51. Tautly stretching the left cable 48 and the right cable 49 in turn leads to tautly stretching the horizontal rack of clothes lines 51 therebetween. The housing 11, the rigid beam 21 and the left folding arm 29 and the right folding arm 39 in their substantially extended forward positions constitute a rigid frame 52 for supporting a washing machine load of wet clothes hung on the horizontal rack of clothes lines 51. The left worm gear 28 and the right worm gear 38 are effectively self-locking in the sense that the clothes hanging device 10 remains in its extended clothes hanging position without operation of the electric motor 24.

Operation of the clothes hanging device 10 between its retracted storage position and its extending clothes hanging position is as follows:

In its retracted storage position, the rigid beam 21 is in its retracted storage position flush with the front panel 12, the clothes rack 22 is fully self-wound, and the left folding arm 29 and the right folding arm 39 are inwardly folded towards one another. The left bracket 37 enables the left front arm 31 to be in front of the left rear arm 32 and the right bracket 47 enables the right front arm 41 to be in front of the right rear arm 42 for facilitating reducing the clothes hanging device 10's width W.

Figure 5A:
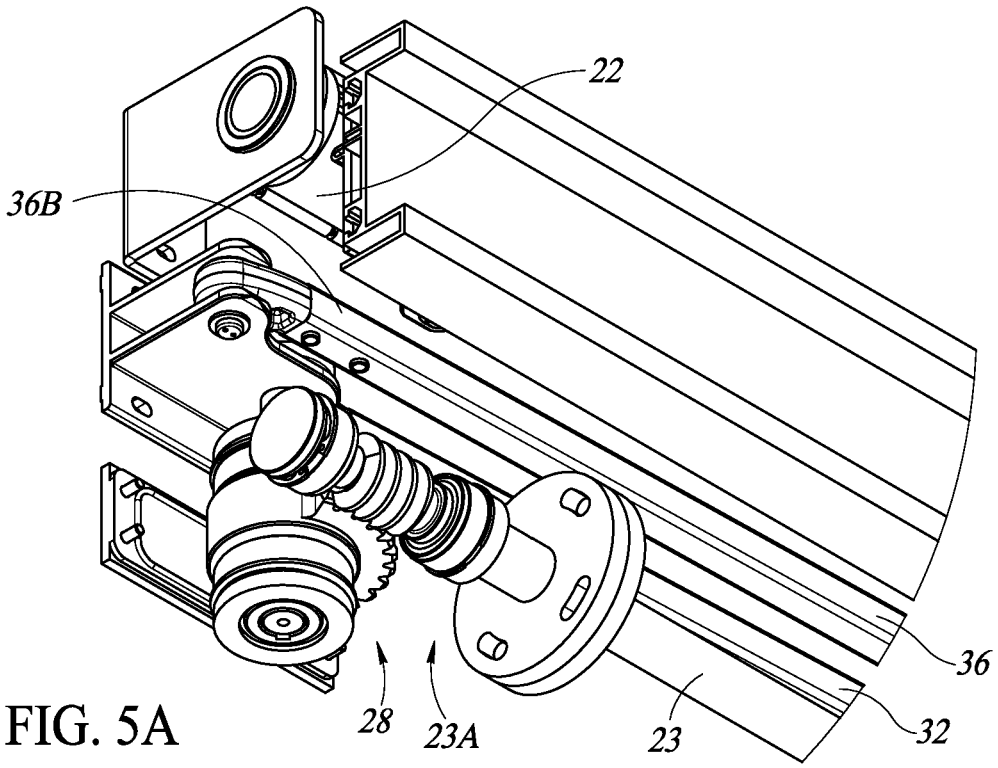
FIG. 5A is a close-up view of a left worm gear of the motorized clothes hanging device in a retracted storage position.
Figure 5B:
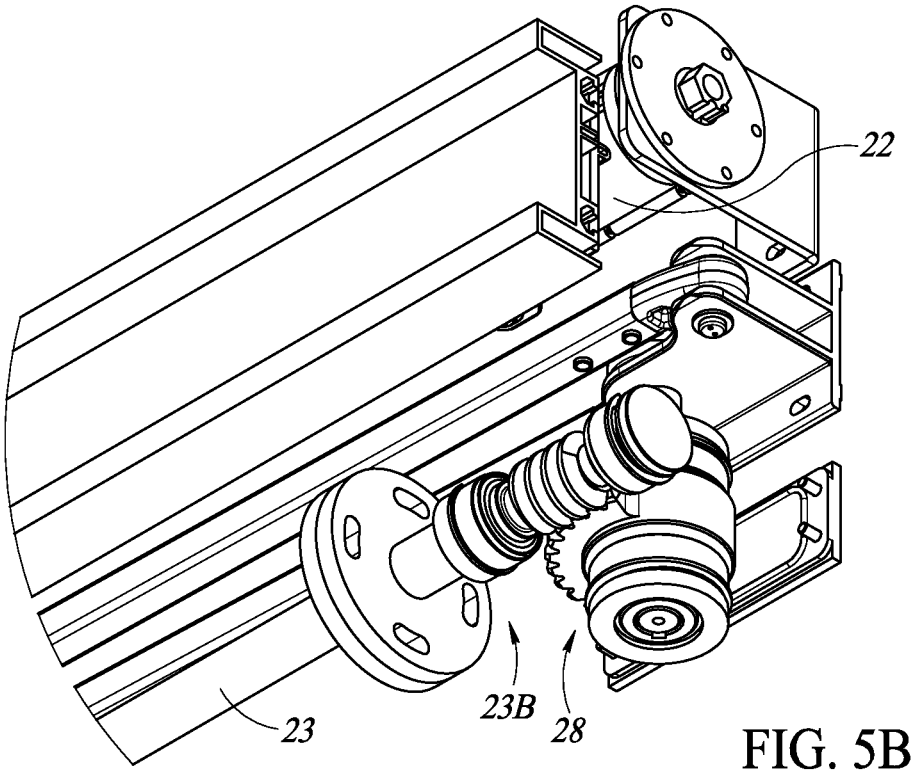
FIG. 5B is a close-up view of a right worm gear of the motorized clothes hanging device in its retracted storage position.

As shown in FIG. 5A, on viewing the left worm gear 28 from the gear transmission 26, clockwise rotation of the axle 23 causes the left worm gear 28 to forwardly rotate the left rear arm 32 a near quarter turn which in turn forwardly rotates the left front arm 31 relative to the left rear arm 32 to extend the left folding arm 29. And as shown in FIG. 5B, the right worm gear 38 simultaneously forwardly rotates the right rear arm 42 a quarter turn which in turn forwardly rotates the right front arm 41 relative to the right rear arm 42 to extend the right folding arm 39. Accordingly, the rigid beam 21 is extended forward from its retracted storage position to its extended forward clothes hanging position until restrained by the full extension of the clothes rack 22 to form the rigid frame 52.

Figure 6A:
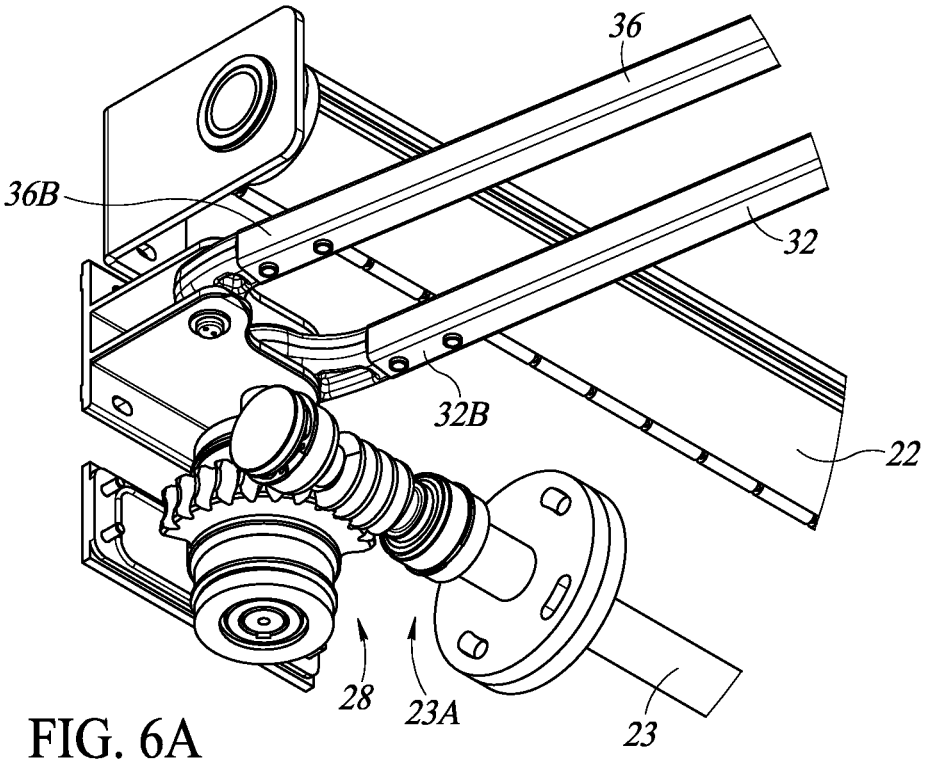
FIG. 6A is a close-up view of the left worm gear of the motorized clothes hanging device in a clothes hanging position.
Figure 6B:
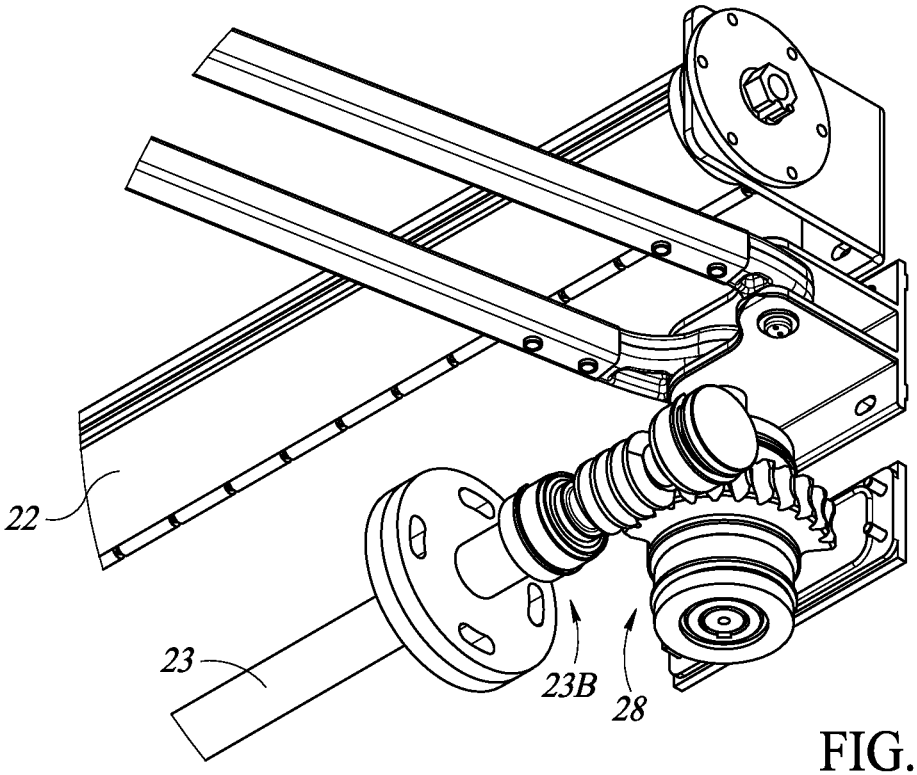
FIG. 6B is a close-up view of the right worm gear of the motorized clothes hanging device in its clothes hanging position.

As shown in FIG. 6A, on viewing the left worm gear 28 from the gear transmission 26, counterclockwise rotation of the axle 23 causes the left worm gear 28 to rearwardly rotate the left rear arm 32 a near quarter turn which in turn rearwardly rotates the left front arm 31 relative to the left rear arm 32 such that the left front arm 31 lies in front of the left rear arm 32. And as shown in FIG. 6B, the right worm gear 38 simultaneously rearwardly rotates the right rear arm 42 a near quarter turn which in turn rearwardly rotates the right front arm 41 relative to the right rear arm 42 such that the right front arm 41 lies in front of the right rear arm 42. Accordingly, the rigid frame 52 collapses controllably enabling the clothes rack 22 to self-rewind in preparation for subsequent forward extending.

While the invention has been described with respect to a limited number of embodiments, it will be appreciated that many variations, modifications, and other applications of the invention can be made within the scope of the appended claims.

The invention claimed is:

1. A wall mounted motorized clothes hanging device comprising:

a) a housing;

b) an axle mounted in said housing, said axle having a left axle end and a right axle end;

c) a rigid beam having a left beam end and a right beam end, said rigid beam having a retracted storage position and an extended clothes hanging position forward of said retracted storage position;

d) a left folding arm including:

a left front arm having a leading left front arm end pivotally connected to said rigid beam and a trailing left front arm end with a left front arm gear wheel, a left rear arm having a leading left rear arm end with a left rear arm gear wheel engaging said left front arm gear wheel and a trailing left rear arm end, a left support arm including a leading left support arm end having a pivotally connected bracket pivotally connected to said trailing left front arm end and said leading left rear arm end, and a trailing left support arm end pivotally connected to said housing, said left folding arm being rotatable between a substantially folded position and a substantially extended forward position;

e) a right folding arm including:

a right front arm having a leading right front arm end pivotally connected to said rigid beam and a trailing right front arm end with a right front arm gear wheel, a right rear arm having a leading right rear arm end with a right rear arm gear wheel engaging said right front arm gear wheel and a trailing right rear arm end, a right support arm including a leading right support arm end having a pivotally connected bracket pivotally connected to said trailing right front arm end and said leading right rear arm end, and a trailing right support arm end pivotally connected to said housing, said right folding arm being rotatable between a substantially folded position and a substantially extended forward position, said right folding arm and said left folding arm being folded toward one another in their said substantially folded positions and said right folding arm and said left folding arm being substantially parallel in their said substantially extended forward positions;

f) a left worm gear at said left axle end for driving said left folding arm between said folded position and said extended forward position;

g) a right worm gear at said right axle end for driving said right folding arm between said folded position and said extended forward position;

h) a motor for rotating said axle in one direction for driving said left worm gear and said right worm gear for extending said rigid beam from said retracted storage position to said extended clothes hanging position whereupon said housing, said left folding arm, said right folding arm and said rigid beam constitute a rigid frame, and said motor rotating said axle in an opposite direction for driving said left worm gear and said right worm gear for retracting said rigid beam from said extended clothes hanging position to said retracted storage position; and i) a self-winding clothes rack including a left cable on said housing's left side, a right cable on said housing's right side, and a roll of clothes lines between said left cable and right cable, said self-winding clothes rack being initially stored in said housing in said retracted storage position and being unwound to present a horizontal rack of clothes lines supported on said rigid frame in said extended clothes hanging position, said self-winding clothes rack enabling extending said rigid beam from said retracted storage position thereby tautly stretching said horizontal rack of clothes lines between said left cable and said right cable and defining said rigid beam's extended clothes hanging position, and said clothes rack self-winding on deploying said rigid beam from said extended clothes hanging position to said retracted storage position.

2. The clothes hanging device according to claim 1 wherein said left cable and said right cable of said self-winding clothes rack are self-winding cables.

* * * * *